US005471918A

United States Patent [19]

Hsieh

[11] Patent Number: 5,471,918

[45] Date of Patent: Dec. 5, 1995

[54] NO-LOAD-RUN STRAP RELEASE CONTROL MECHANISM FOR A STRAPPING MACHINE

[76] Inventor: Li-Tsu Hsieh, No. 2, Lane 13, Fu Ping Road, Tai Ping Hsiang, Taichung Hsien, Taiwan

[21] Appl. No.: 380,551

[22] Filed: Jan. 30, 1995

[51] Int. Cl.[6] ..... B65B 13/32

[52] U.S. Cl. ..... 100/4; 100/29; 100/33 PB

[58] Field of Search ..... 100/4, 26, 29, 100/33 PB

[56] References Cited

U.S. PATENT DOCUMENTS

| | | | |
|---|---|---|---|
| 3,636,861 | 1/1971 | Weller | 100/33 PB |
| 4,016,023 | 4/1977 | Takami | 100/33 PB |
| 4,020,756 | 5/1977 | Weiss | 100/33 PB |
| 4,409,058 | 10/1983 | Suwabe et al. | 100/33 PB |
| 4,850,179 | 7/1989 | Takami | 100/33 PB |
| 4,912,912 | 4/1990 | Tagomori | 100/29 |
| 4,955,180 | 9/1990 | Sakaki et al. | 100/4 |
| 5,155,982 | 10/1992 | Boek et al. | 100/29 |

*Primary Examiner*—Stephen F. Gerrity

*Attorney, Agent, or Firm*—Morton J. Rosenberg; David I. Klein

[57] ABSTRACT

A no-load-run strap release control mechanism including a holder pivotably mounted in the output end of the strap guiding arch of a strapping machine, a movable member, a link pivotably connected between the holder and the movable member, a control switch connected to a timer, a holding-down device controlled by the timer to hold down the welding mechanism of the strapping machine upon a no-load-run of the packing strap, permitting the looped packing strap to extend out into the straight shape and moved out of the slide carrier of the strapping machine after the end of the strapping cycle.

1 Claim, 3 Drawing Sheets

NO-LOAD-RUN STRAP RELEASE CONTROL MECHANISM FOR A STRAPPING MACHINE

BACKGROUND OF THE INVENTION

The present invention relates to a no-load-run strap release control mechanism for a strapping machine which uses a brake mechanism to stop the welding mechanism from operating during the release of a no-load-run strap.

Regular strapping machines commonly use polypropylene straps to tie up things. When a strapping machine is used, a no-load-run will occur when the control switch is triggered by an error. FIG. 1 shows a no-load-run strap release control mechanism according to the prior art, which comprises a rotary table 61 with a cut 611 securely fixed to the return wheel 6, and a proximity detector 62 disposed adjacent to the rotary table 61. When the strap is stretched during the binding process, the revolving speed of the rotary table 61 is reduced, and the proximity detector 62 is induced to send a signal to the control circuit, so that the control circuit drives the cutting and welding mechanism of the strapping machine to cut and seal the strap. If a no-load-run occurs, the proximity detector 62 detects no signal, and the cam (not shown) of the strapping machine will trigger a limit switch, causing the cam reversed after cutting off the strap and before the proceeding of the welding process, permitting the looped strap section to trip off by means of its resilient material property. Because the cam must be forced to rotate in the reversed direction upon the occurence of a no-load-run, a reversible motor must be installed to turn the cam. Furthermore, a same mechanism must be installed in the forward wheel 63 of the strapping machine. As dust tends to occur during the strapping procedure, the proximity detectors 62 will be covered with dust easily, causing detecting errors.

SUMMARY OF THE INVENTION

The present invention has been accomplished to provide a no-load-run strap release control mechanism for a strapping machine which eliminates the aforesaid drawbacks. According to the preferred embodiment of the present invention, a brake mechanism is mounted between one end of the strap guiding arch of the strapping machine and the welding mechanism thereof and controlled by a timer to hold down the welding mechanism upon a no-load-run of the packing strap, permitting the looped packing strap to extend out into the straight shape and moved out of the slide carrier of the strapping machine after the end of the strapping cycle. This arragenemtn eliminates the installation of the prior art proximity detectors.

DETAILED DESCRIPTION OF THE PREFERRED EMBODIMENT

Figure 1:
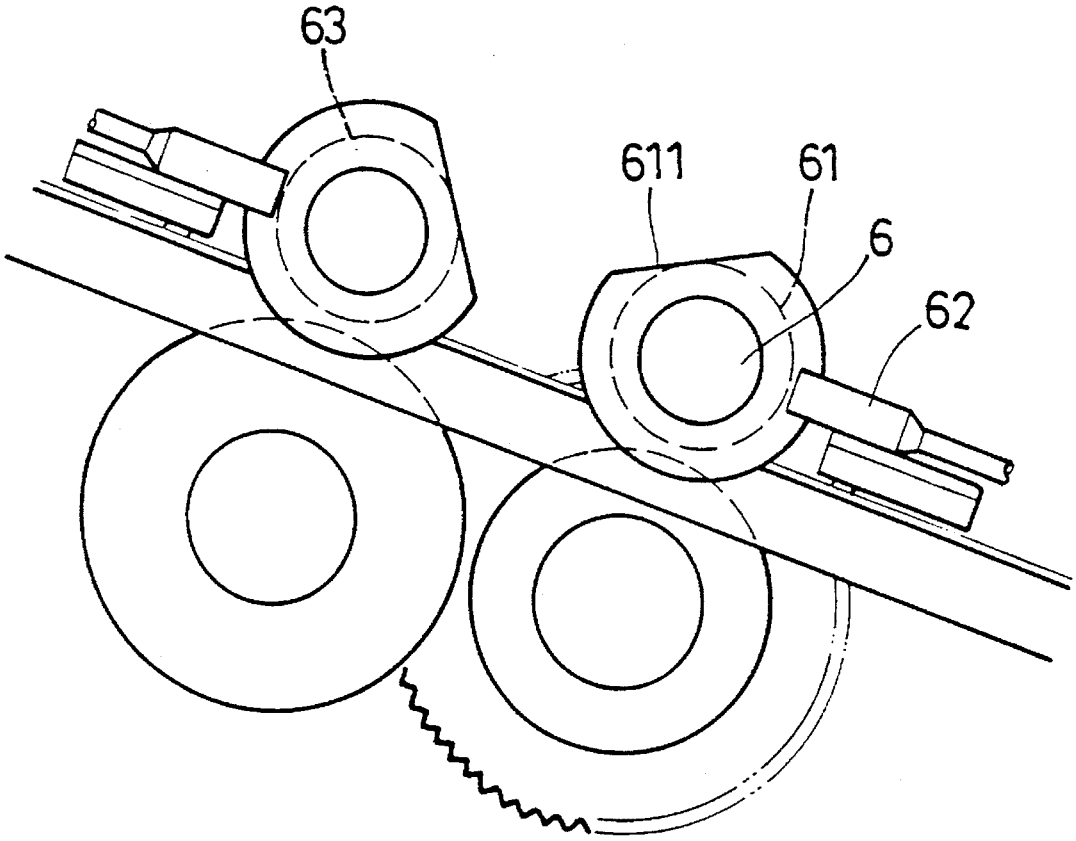
PRIOR ART FIG. 1
FIG. 1 shows a no-load-run strap release control control mechanism according to the prior art.
Figure 2:
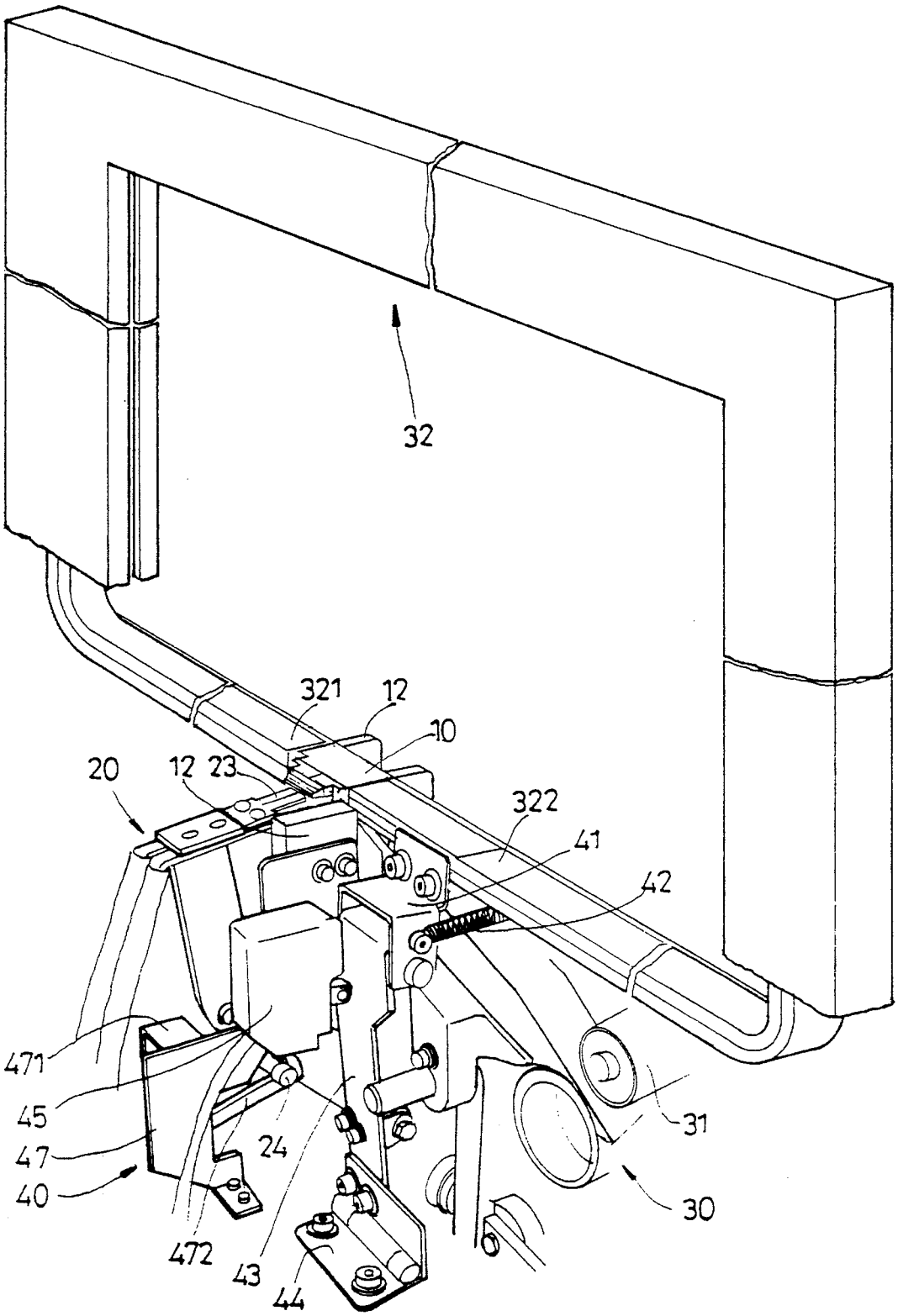
FIG. 2 is a no-load-run strap release control mechanism according to the present invention.
Figure 3:
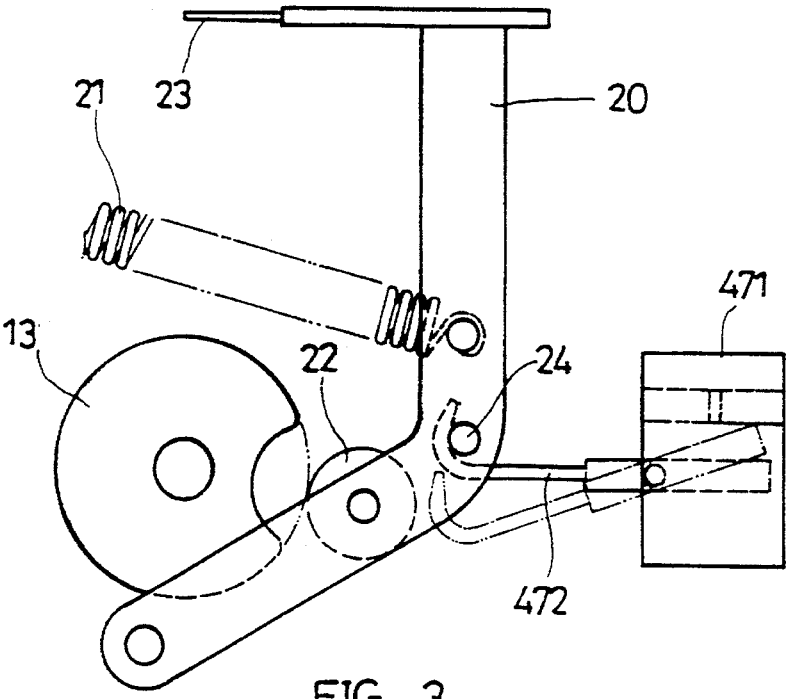
FIG. 3 is a schematic drawing of the brake mechanism of the no-load-run strap release control mechanism shown in FIG. 2, showing the solenoid valve operated and the hook hooked on the coupling rod of the welding mechanism.
Figure 4:
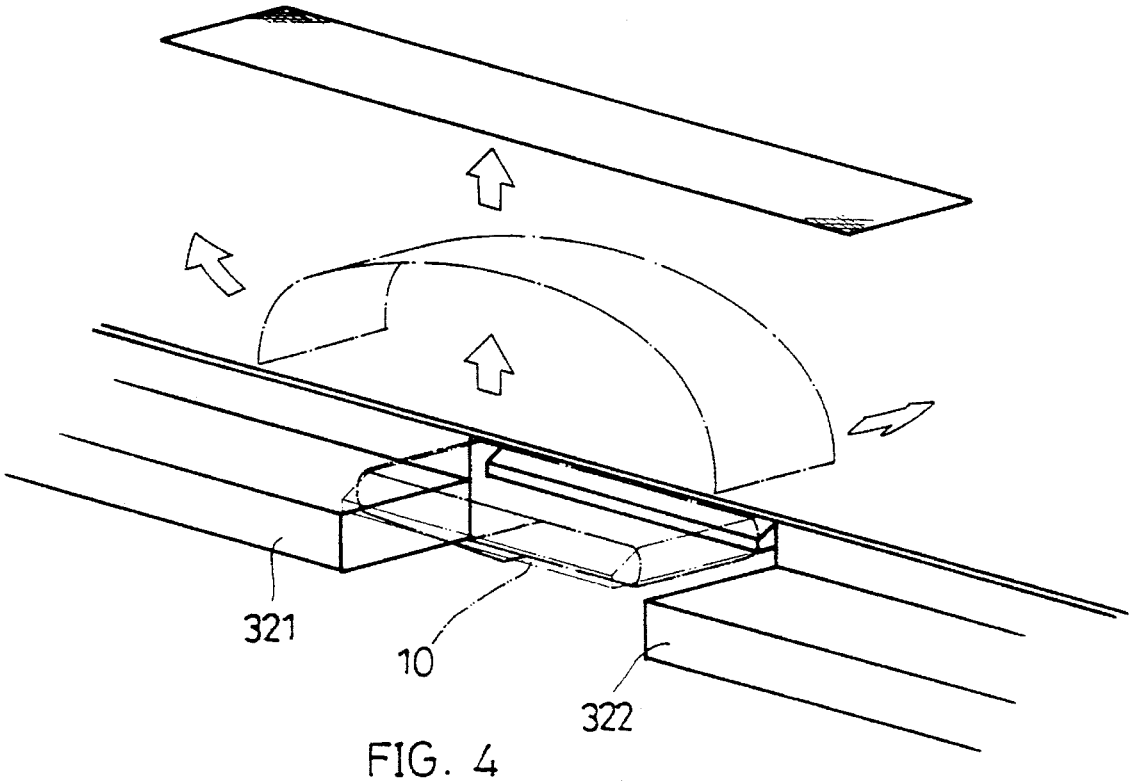
FIG. 4 is a schematic drawing showing the polypropylene strap released from the slide carrier and returned to the straight shape according to the present invention.

Referring to FIGS. 2, 3, and 4, the present invention comprises a slide carrier 10, a welding mechanism 20, a strap guiding mechanism 30, and a brake mechanism 40. The slide carrier 10 is mounted on the frame 12 of the strapping machine and reciprocated horizontally.

The welding mechanism 20 is pivoted to the frame 12 at the bottom and pulled by a tensile spring 21 to force a guide wheel 22 thereof into contact with the transmission cam 13 of the strapping machine. The top end of the welding mechanism 20 is securely fixed with a electric heating plate 23, The welding mechanism 20 further comprises a coupling rod 24 in the middle. The strap guiding mechanism 30 comprises a set of guide rollers 31 controlled to let, off or take up the polypropylene strap. The output end of the strap guiding mechanism 30 is connected to the input end 321 of the strap guiding arch 32. The output end 322 of the strap guiding arch 32 is disposed above the output end of the set of guide rollers 31.

The brake mechanism 40 comprises a holder 41 mounted in the output end 322 of the strap guiding arch 32 and connected to the frame 12 by a tensile spring 42, a movable member 44, a link pivotably connected between the holder 41 and the movable member 44, a control switch 45 disposed at one side by the link 43 and controlled to operate by the link 43, a timer (not shown) connected to the control switch 45, and a holding-down device 47 controlled by the timer. When the polypropylene strap is taken up to stretch open the output end 322 of the strap guiding arch 32 and to force the holder 41 outwards, the tensile spring 42 immediately pulls the holder 41 back to its former position. The holding-down device 47 comprises a solenoid valve 471 and a hook 472 connected to the solenoid valve 471. When the solenoid valve 471 is triggered by the timer, the hook 472 is driven by the solenoid valve 471 to hook on the coupling rod 24 of the welding mechanism 20.

When the set of guide rollers 31 are rotated in the reversed direction, the polypropylene strap is pulled to stretch open the input end 321 of the strap guiding arch 32 and to escape out of the strap, guiding arch 32. After the polypropylene strap is wound round the load before the welding process is proceeded, the output end 322 of the strap guiding arch 32 is maintained open. This time period is set for the timer of the brake mechanism 40. When the output end 322 of the strap guiding arch 32 is stretched open, the link 43 is forced toward the control switch 45, causing the control switch 45 to turn on the timer while the solenoid valve 471 of the holding-down device 47 is maintained disenergized.

When a no-load-run occurs, the polypropylene strap is wound round the slide carrier 10 rapidly, therefore the time period in which the output end 322 of the strap guiding arch 32 is stretched open is shorter than the set length of time of the timer, permitting electric power supply to pass from the control switch 45 through the timer to the solenoid valve 471 of the holding-down device 47. When the solenoid valve 471 is triggered, the hook 472 is driven by the solenoid valve 471 to hook on the coupling rod 24 of the welding mechanism 20. Therefore, the welding mechanism 20 does no work when the strap is moved in a no-load-run. When the slide carrier 10 is moved away, the lopped polypropylene strap immediately returns to the straight shape, as shown in FIG. 4, by means of the effect of its resilient material.

What is claimed is:

1. A no-load-run strap release control mechanism for a strapping machine, comprising a transmission cam, a machine frame, a slide carrier reciprocated horizontally on said machine frame, a welding mechanism pivoted to said machine frame and driven by a tensile spring to force a guide wheel into contact with said transmission cam, a strap guiding mechanism consisting of a strap guiding arch and a set of guide rollers, said set of guide rollers being driven to let off or take up a polypropylene packing strap, said strap guiding arch having an input end and an output end, the set of guide rollers having an output end for guiding said polypropylene packing strap into the input end of said strap guiding arch, the output end of said strap guiding arch being disposed above the output end of said set of guide rollers, wherein a brake mechanism is installed in said frame to stop said welding mechanism from operating when said polypropylene packing strap is moved for in no-load-run, said brake mechanism comprising a holder mounted in the output end of said strap guiding arch and connected to said frame by a tensile spring, a movable member, a link pivotably connected between said holder and said movable member, a control switch disposed at one side by said link and controlled to operate when said link is oscillated, a timer controlled by said control switch, and a holding-down device controlled by said timer, said holding-down device comprising a solenoid valve controlled by said timer, and a hook moved by said solenoid valve to hold down said welding mechanism when said solenoid valve is energized by said timer.

* * * * *